US010414548B2

(12) United States Patent
Liu

(10) Patent No.: US 10,414,548 B2
(45) Date of Patent: Sep. 17, 2019

(54) SEALABLE BAG

(71) Applicant: Molia Packaging USA, Inc., Arlington Heights, IL (US)

(72) Inventor: Chao Liu, QingDao (CN)

(73) Assignee: MOLIA PACKAGING USA, INC., Arlington Heights, IL (US)

( * ) Notice: Subject to any disclaimer, the term of this patent is extended or adjusted under 35 U.S.C. 154(b) by 0 days.

(21) Appl. No.: 15/970,350

(22) Filed: May 3, 2018

(65) Prior Publication Data

US 2018/0319546 A1 Nov. 8, 2018

Related U.S. Application Data

(60) Provisional application No. 62/501,813, filed on May 5, 2017.

(51) Int. Cl.
*B65D 33/25* (2006.01)

(52) U.S. Cl.
CPC ..... *B65D 33/2541* (2013.01); *B65D 33/2508* (2013.01)

(58) Field of Classification Search
CPC ..... B65D 33/2541; B65D 33/2508
USPC ..... 383/63
See application file for complete search history.

(56) References Cited

U.S. PATENT DOCUMENTS

| | | | | | |
|---|---|---|---|---|---|
| 4,878,763 | A * | 11/1989 | Ausnit | B65D 33/2508 | 383/65 |
| 5,272,794 | A * | 12/1993 | Hamatani | A44B 19/16 | 24/586.1 |
| 5,931,582 | A * | 8/1999 | Nichols | B65D 33/2541 | 24/DIG. 50 |
| 9,284,097 | B2 * | 3/2016 | Heckman | B65D 33/2508 | |
| 9,957,087 | B2 * | 5/2018 | Takigawa | B65D 33/2508 | |
| 10,011,404 | B1 * | 7/2018 | Kirsh | B65D 50/00 | |
| 10,099,818 | B2 * | 10/2018 | Sprehe | B65D 33/2508 | |
| 10,118,737 | B2 * | 11/2018 | Septien Rojas | B65D 33/2508 | |
| 10,124,932 | B2 * | 11/2018 | Martial | B65D 33/24 | |
| 2018/0127155 | A1 * | 5/2018 | Johnston | B65D 33/2508 | |
| 2018/0257820 | A1 * | 9/2018 | Tameda | B65D 33/00 | |

* cited by examiner

*Primary Examiner* — Jes F Pascua
(74) *Attorney, Agent, or Firm* — Bishop, Diehl & Lee Ltd.

(57) ABSTRACT

The present invention provides a method of opening a zipper-sealed bag having first and second opposing sidewalls, a zipper tape seal attached to the bag at the opening and configured to be alternated between a sealed and unsealed state, the seal having a first sealing member secured to the first sidewall along a portion of the opening, and a second sealing member secured to the second sidewall along a portion of the opening, the first sidewall having a first flap at a top edge thereof, and the second sidewall having a second flap at a top edge thereof, the method comprising grasping the first sidewall with a user's first hand, grasping the second sidewall with a user's other hand, the user pressing with a downward force on each of the first and second sealing members while simultaneously pulling the sidewalls in generally opposing directions.

19 Claims, 7 Drawing Sheets

SEALABLE BAG

RELATED APPLICATION

The present application claims the filing priority of U.S. Provisional Application No. 62/501,813 titled "SEALABLE BAG" and filed on May 5, 2017. The '813 application is hereby incorporated by reference.

TECHNICAL FIELD OF THE INVENTION

The present application relates to a sealable bag. Particularly, the application relates to a sealable bag which has an airtight zipper seal offering distinct advantages such as child safety. The sealable bag also has low oxidation and water vapor transmission rates. The present invention also relates to methods for creating, sealing and unsealing such a sealable bag.

BACKGROUND OF THE INVENTION

A standard sealable bag has one seal that is easily opened by children of any age. A child, therefore, can easily access potentially harmful or delicate items stored in a standard sealable bag. Furthermore, standard sealable bags may not be airtight or water vapor resistant, which allows for items stored therein to undergo oxidation, take in moisture, or experience unwanted opening during handling or transport. Additionally, standard sealable bags and their contents can be easily damaged when used in transporting various types of goods.

The sealable bag of the present invention safely secures items from children. Additionally, the sealable bag protects stored items from the negative effects of oxidation and moisture, as well as to safely transport various goods to prevent damage to stored items due to unwanted opening of the bag. These and other problems are addressed by the present invention to provide numerous advantages in operation and effectiveness.

SUMMARY OF THE INVENTION

There is disclosed herein an improved sealable bag assembly which avoids the disadvantages of prior devices while affording additional structural and operating advantages. In an embodiment, the sealable bag of the present invention includes a bag having an opening. A zipper tape seal is attached to the bag at the opening and configured to be alternated between a sealed and unsealed state. The zipper tape seal includes a first sealing member secured to a first bag sidewall along a portion of the opening. The first sealing member includes a first extension and a receiving element. The receiving element has an upper segment with a substantially C-shaped cross-section and a lower segment with a substantially C-shaped cross-section smaller than and extending from the upper segment. One end of the first extension connects to the first bag sidewall and another end connects to the upper segment of the receiving element. The zipper tape seal also includes a second sealing member secured to a second bag sidewall along another portion of the opening opposite the first sealing member. The second sealing member includes a second extension and an insertion element. The insertion element has an upper segment with a substantially C-shaped cross-section and a lower segment with a substantially J-shaped cross-section extending from the upper segment. One end of the second extension connects to the second bag sidewall and another end connects to the lower segment of the insertion element. When the zipper tape seal is in the sealed state, the upper segment of the insertion element nests within the upper segment of the receiving element and the lower segment of the insertion element nests within the lower segment of the receiving element.

In another embodiment, the present invention provides a method of opening a zipper-sealed bag having first and second opposing sidewalls, an opening between the first and second sidewalls. The bag also includes a zipper tape seal attached to the bag at the opening and is configured to be alternated between a sealed and unsealed state. The seal has a first sealing member secured to the first sidewall along a portion of the opening, and a second sealing member secured to the second sidewall along a portion of the opening. The first sidewall has a first flap at a top edge thereof. The second sidewall has a second flap at a top edge thereof. The method includes the steps of grasping the first sidewall with a user's first hand, and grasping the second sidewall with a user's other hand. The user presses with a downward force on each of the first and second sealing members while simultaneously pulling the sidewalls in generally opposing directions.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings and appendices embodiments thereof, from an inspection of which, when considered in connection with the following description, the subject matter sought to be protected, its construction and operation, and many of its advantages should be readily understood and appreciated.

FIG. 9 is a schematic of a sealable bag in accord with an embodiment of the present invention wherein the zipper tape seal is located proximate to a bag sidewall.

DETAILED DESCRIPTION OF PREFERRED EMBODIMENTS

Figure 1:
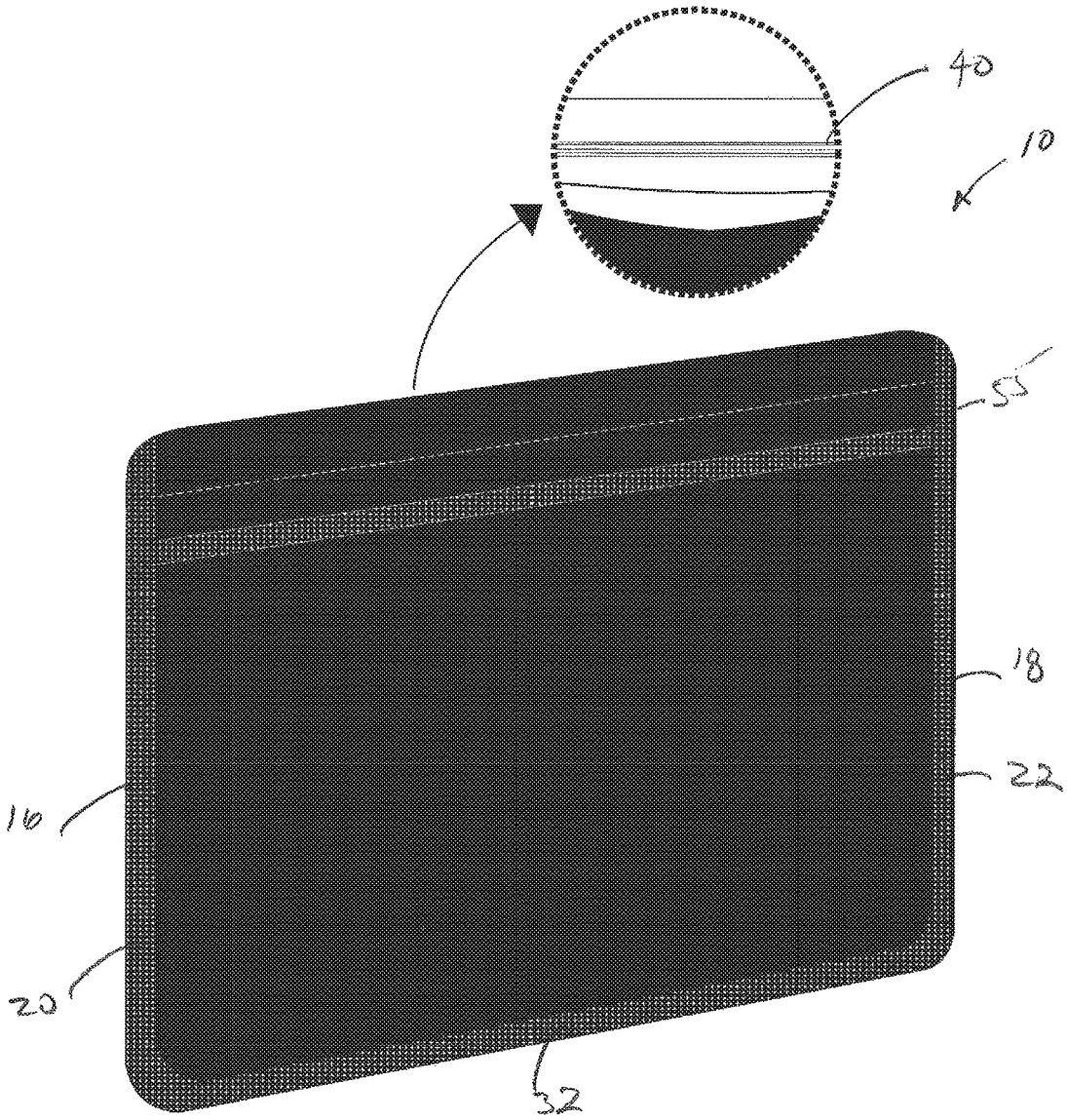
FIG. 1 is a perspective view of a sealable bag in accord with an embodiment of the present invention.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention of embodiments illustrated.

Referring to the Figures, there is illustrated a sealable bag 10 in accord with an embodiment of the present invention. The bag 10 is preferably made of a plastic material having low oxygen and water vapor transmission rates, making the bag 10 highly impermeable thereto. In an embodiment, the bag 10 is made from layers of polyethylene terephthalate (PET), vacuum metallized PET (VMPET), linear low-density polyethylene (LLDPE), and/or any suitable low permeability material, or combination of layers of such materials. The bag 10 material may also include a thermal insulating layer.

In a preferred embodiment, the bag 10 is made of a 12 μm layer of PET, a 12 μm layer of VMPET and a 110 μm layer of LLDPE. In this embodiment, the resulting bag 10 has a water vapor transmission rate in the range of 5 $g/m^2$ for a 24 hour period, and an oxygen transmission rate less than or equal to 43 $cm^3/m^2$ for a 24 hour period at 0.1 MPa pressure. The bag 10 can be made in any desired size suitable to the application. Typical sizes are 9 inches by 12 inches, or 6 inches by 8 inches.

In a preferred embodiment, the bag 10 material has a tensile strength of greater than 15 $lbs/mm^2$ in the machine and transverse directions. The elongation at break, or fracture strain of the bag 10 material is greater than 51% in the machine direction and greater than 47% in the transverse direction. The tensile strength of the bag 10 material is greater than 9.2N in the machine direction and greater than 7.2N in the transverse direction.

The bag 10 includes a first sidewall 12 and a second sidewall 14. The first and second sidewalls 12 and 14 are sealed together along a first side edge 16 and a second side edge 18 by a first side edge seal 20 and second side edge seal 22. In an embodiment, the first and second side edge seals 20 and 22 are sealed using a heat seal, although any suitable sealing method can be used. The first and second sidewalls 12 and 14 have exterior sides 24 and 26, and interior sides 28 and 30, respectively. The first and second sidewalls 12 and 14 may be sealed along a bottom 32 similar to first and second side edge seals 20 and 22.

In a preferred embodiment, the bag 10 is formed from a single sheet of material folded to create first and second sidewalls 12 and 14, thereby eliminating the need for a seal at the bottom 32. The bottom 32 of the bag 10 can be gusseted to allow expansion of the bag 10.

The bag 10 has an opening 34 formed between first and second top edges 36 and 38 of first and second sidewalls 12 and 14. A zipper tape seal 40 extends between the first and second side edges 16 and 18 on the interior sides 28 and 30 of the first and second sidewalls 12 and 14. The zipper tape seal 40 includes a first sealing member 42 secured to the interior side 28 of the first sidewall 12 and a second sealing member 44 secured to the interior side 30 of the second panel 14. As will be shown below, the first and second sealing members 42 and 44 are interconnected to form the seal 40. In a preferred embodiment the zipper tape seal 40 is located a distance from the top edges 36 and 38 of the panels 12 and 14 for reasons that will become apparent below. The first and second sealing members 42 and 44 are preferably made from a plastic material such as polyethylene, but can be made of any suitable material.

In an embodiment, the first sealing member 42 includes a first extension 46 and a receiving element 48. The receiving element 48 has an upper segment 50 with a substantially C-shaped cross-section, and a lower segment 52 with a substantially C-shaped cross-section smaller than and extending from the upper segment 50. A first end 54 of the first extension 46 connects to the interior side 28 of the first sidewall 12. In an embodiment, the first end 54 is connected to the interior side 28 by heat sealing. The heat seal 55 should be of a sufficient strength to withstand the forces described below for opening the bag. A second end 56 of the first extension 46 connects to the upper segment 50 of the receiving element 48.

In this embodiment, the second sealing member 44 includes a second extension 58 and an insertion element 60. The insertion element 60 includes an upper segment 62 with a substantially C-shaped cross-section, and a lower segment 64 with a substantially J-shaped cross-section extending from the upper segment 62. A first end 66 of the second extension 58 connects to the interior side 30 of the second sidewall 14 opposite the first sidewall 12. In an embodiment, the first end 66 is connected to the interior side 30 by heat sealing. A second end 68 of the second extension 58 connects to the lower segment 64 of the insertion element 60. The first and second extensions 45 and 58 are preferably parallel to their respective sidewalls. Sealing members 42 and 44 are located a distance from the top edges 36 and 38 to create first and second flaps 70 and 72.

Figure 2:
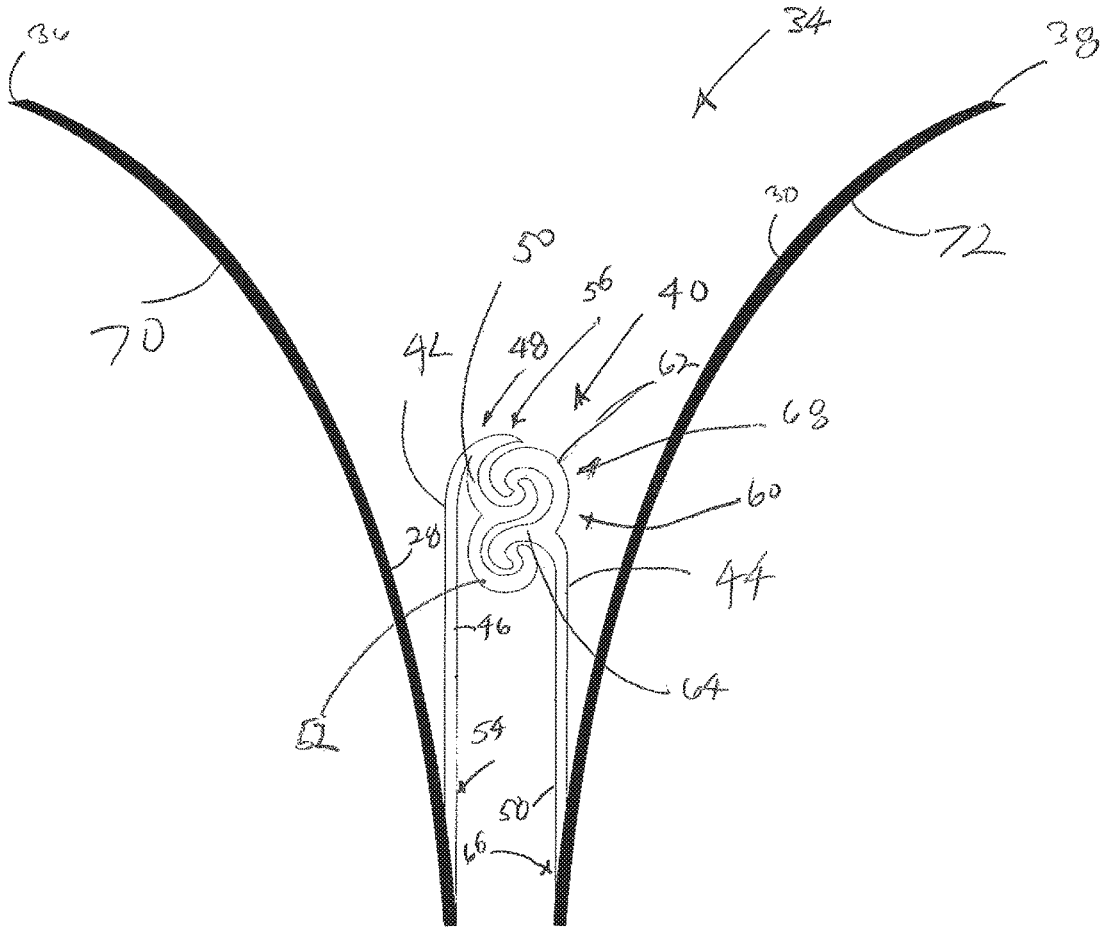
FIG. 2 is schematic view of a zipper tape seal in accord with an embodiment of the present invention.
Figure 3:
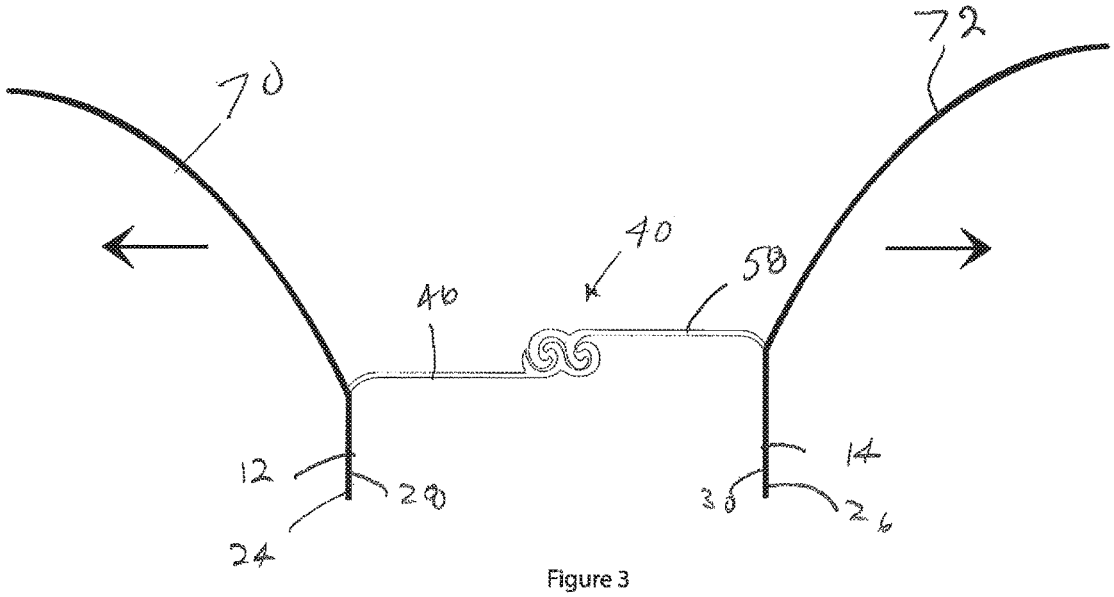
FIG. 3 is a schematic view of a zipper tape seal with outward pressure being applied in accord with an embodiment of the present invention.

The zipper tape seal 40, has an unsealed state (FIGS. 2 and 3) and a sealed state. To seal the zipper tape seal 40, and thereby the bag 10, a user squeezes together, using thumb and forefinger, the first and second sealing members 42 and 44 such that in the sealed state, the upper segment 62 of the insertion element 60 nests within the upper segment 50 of the receiving element 48, and the lower segment 64 of the insertion element 60 nests within the lower segment 52 of the receiving element 48.

Figure 4:
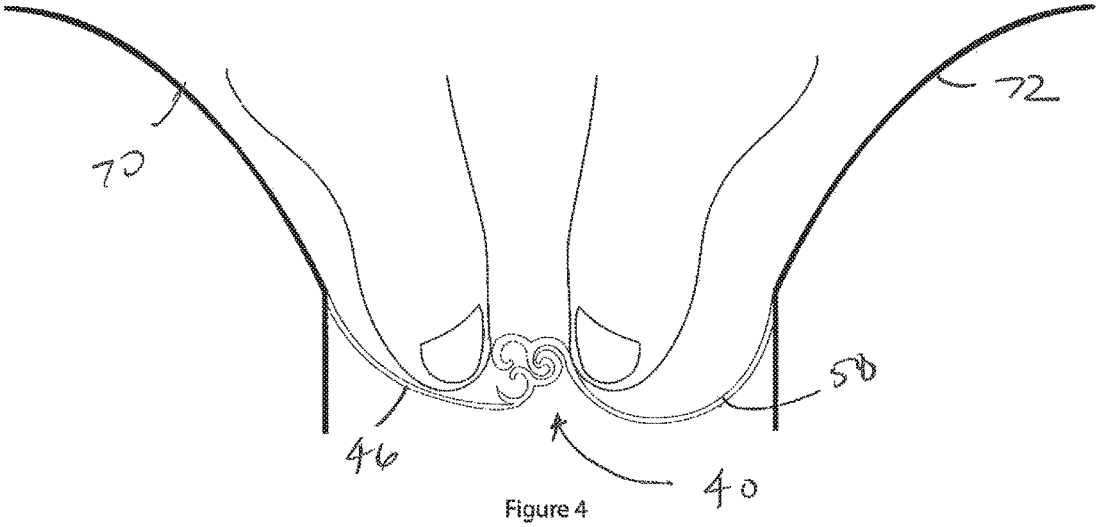
FIG. 4 is a schematic view a zipper tape seal being unsealed in accord with an embodiment of the present invention.
Figure 5:
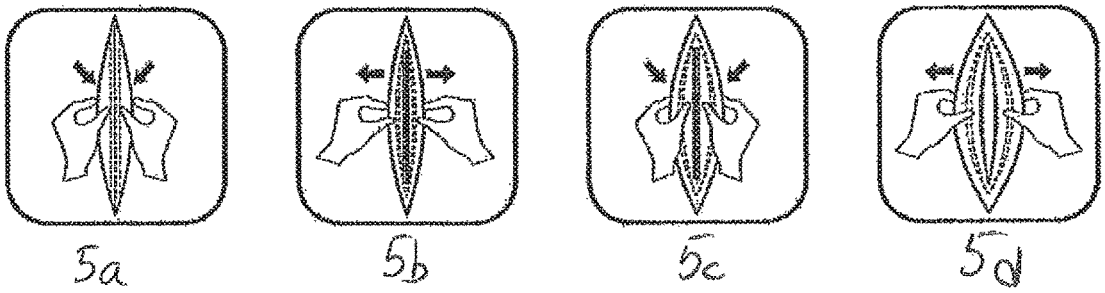
FIG. 5 is an instructional diagram of how to open and lock a sealable bag in accord with an embodiment of the present invention.
Figure 6:
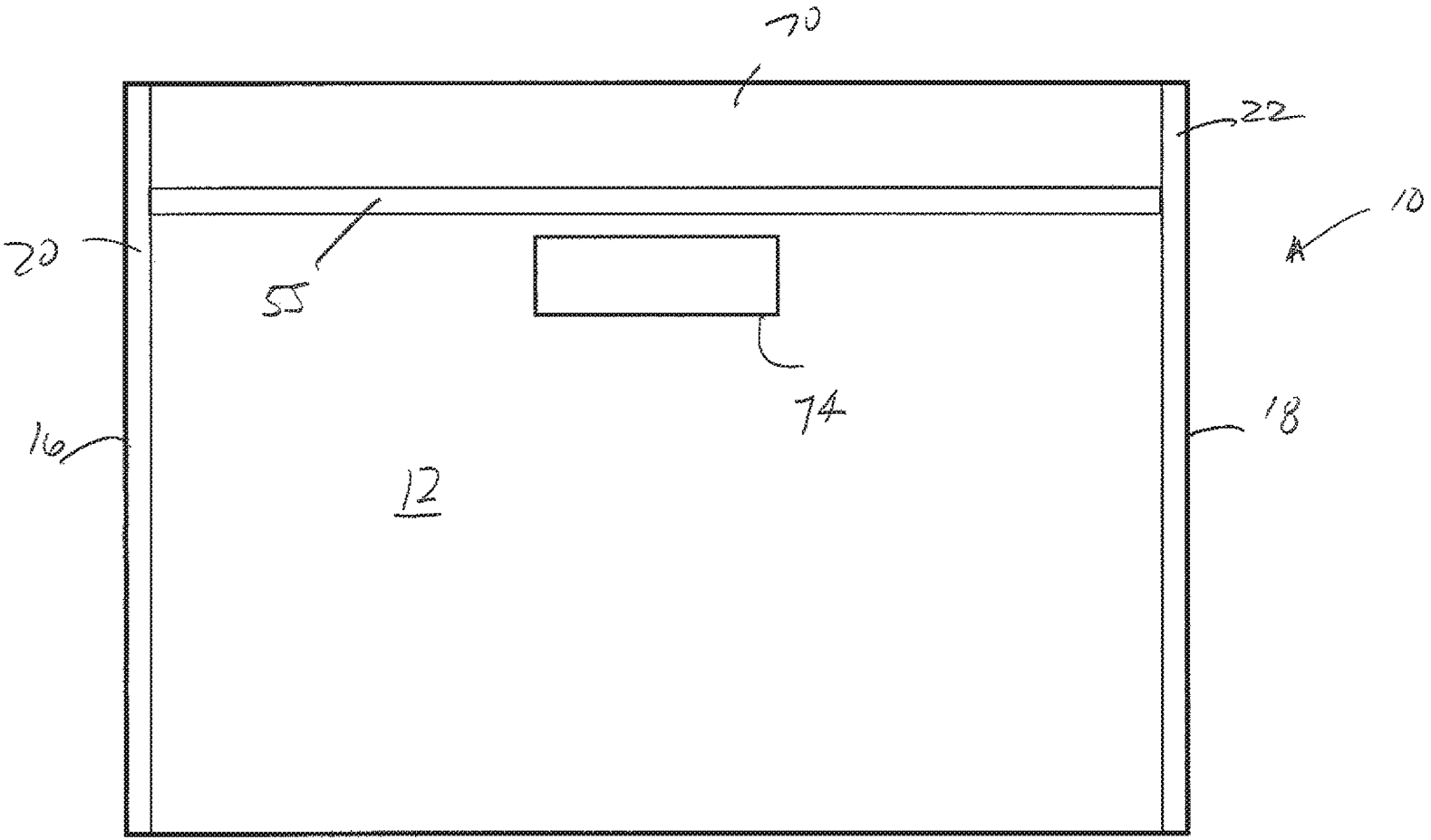
FIG. 6 is a side view of a sealable bag of the present invention including a finger hold in accord with an embodiment of the present invention.
Figure 6:
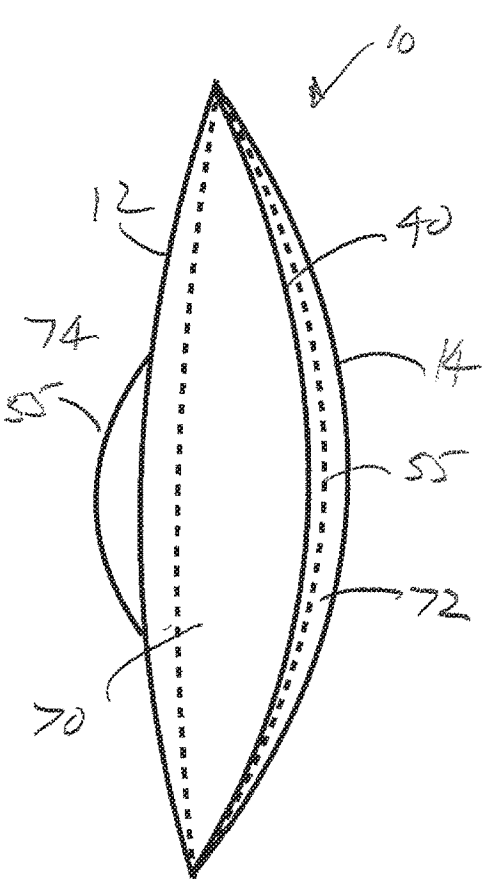
Figure 8:
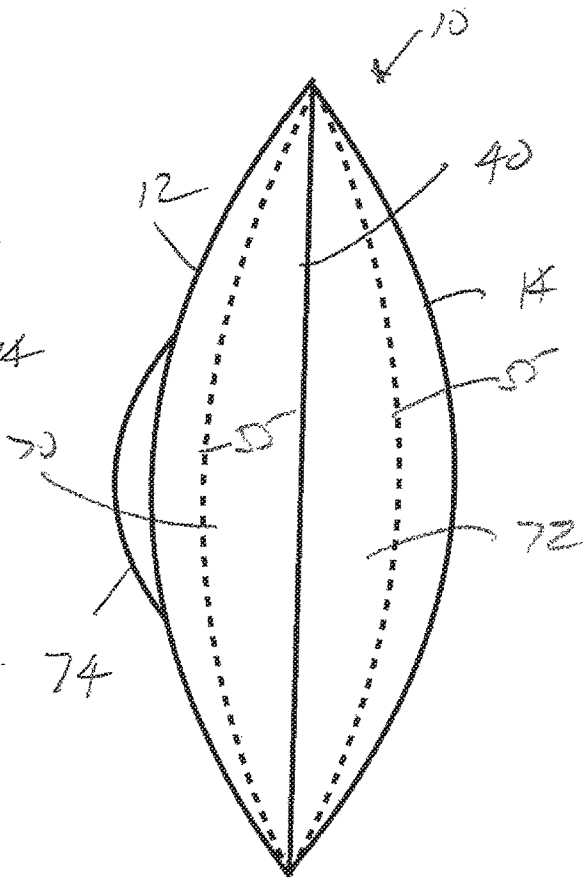
FIG. 8 is a schematic of a sealable bag in accord with an embodiment of the present invention including a finger hold.
Figure 7:
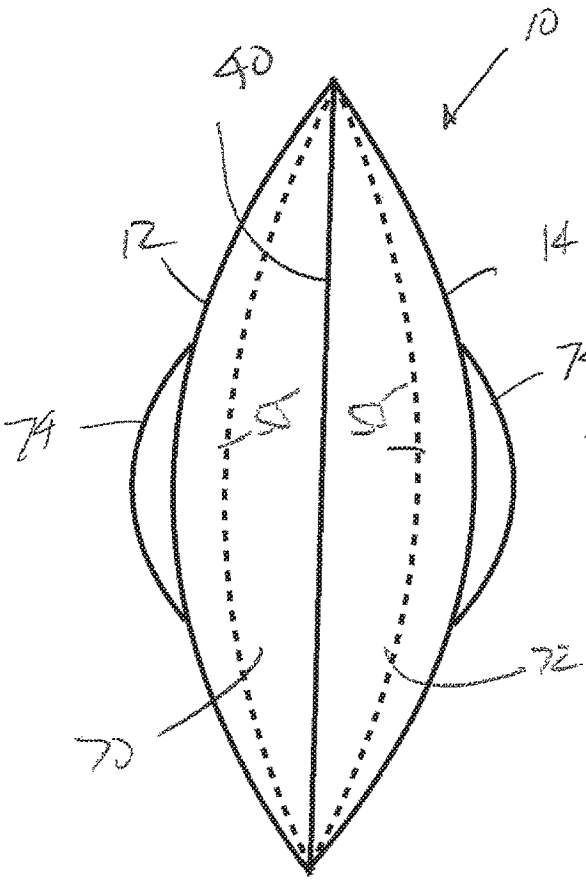
FIG. 7 is a schematic of a sealable bag in accord with an embodiment of the present invention including a pair of finger holds.

To open the zipper tape seal 40 as shown in FIGS. 4 and 5, the user grasps first and second flaps 70 and 72 with either hand, and places his or her thumbs on either side of the seal 40 (FIGS. 4 and 5*a*), on or near the first and second sealing members 42 and 44. The user pushes with his thumbs in a downward direction thereby opening the seal 40, and pulls the flaps 70 and 72 apart to open the bag 10 (FIGS. 4 and 5*b-d*). In a preferred embodiment, the downward force is approximately 84.6 N or 19 lbs. of force.

Due to the configuration of the seal 40 of the present invention, the seal 40 strength is such that if the user attempts to open the bag 10 simply by pulling outwardly on the flaps 70 and 72 in opposite directions, the bag 10 will not open (FIG. 4). In a preferred embodiment, the sealing strength is approximately 26 pounds of force as measured by a GBS-S Electronic Tensile Tester, but should be of a strength sufficient for the bag to be secure and childproof Thus, the seal 40 and the bag 10 is essentially childproof as a child will not have the strength to open the seal 40, nor will the child know or be able to open the bag 10 using his thumbs, nor have the strength to do so, while simultaneously pulling open the flaps 70 and 72 as described above.

In another embodiment, at least one of the first or second bag sidewalls 12 and 14 includes a finger hold 74 (FIGS. 6-9). The finger hold 74 may be formed integral with the sidewalls 12 or 14, or may be attached to sidewalls 12 or 14. The finger hold 74 may be of the same material as the sidewalls 12 and 14, or may be any other suitable material. In this embodiment, to open the bag 10, the user inserts a finger or fingers on opposite hands in the finger hold 74 to assist in pulling the sidewalls 12 and 14 in generally opposing directions while also asserting the downward force described above on the first and second sealing members 42 and 44. In a further embodiment, the zipper tape seal 40 is located proximate to one of the interior sides 28 and 30 of the bag sidewalls 12 and 14, and the finger hold 74 is located in the opposing sidewall (FIG. 9).

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A zipper bag sealing assembly comprising:

a bag having an opening;

a zipper tape seal attached to the bag at the opening and configured to be alternated between a sealed and unsealed state, the zipper tape seal including:

a first sealing member secured to a first bag sidewall along a portion of the opening, the first sealing member including a first extension and a receiving element, the receiving element having an upper segment with a substantially C-shaped cross-section and a lower segment with a substantially C-shaped cross-section smaller than and extending from the upper segment, wherein one end of the first extension connects to the first bag sidewall and another end connects to the upper segment of the receiving element; and a second sealing member secured to a second bag sidewall along another portion of the opening opposite the first sealing member, the second sealing member including a second extension and an insertion element, the insertion element having an upper segment with a substantially C-shaped cross-section and a lower segment with a substantially J-shaped cross-section extending from the upper segment, wherein one end of the second extension connects to the second bag sidewall and another end connects to the lower segment of the insertion element;

wherein when the zipper tape seal is in the sealed state the upper segment of the insertion element nests within the upper segment of the receiving element and the lower segment of the insertion element nests within the lower segment of the receiving element.

2. The zipper bag sealing assembly of claim 1, wherein the first and second sealing members are attached to the first and second bag sidewalls such that the first and second extensions are parallel to their respective bag sidewall.

3. The zipper bag sealing assembly of claim 2, wherein the end of the first and second extensions are heat-sealed to their respective bag sidewall.

4. The zipper bag sealing assembly of claim 1 further comprising a first flap at a top edge of the first sidewall, and a second flap at a top edge of the second sidewall.

5. The zipper bag sealing assembly of claim 1, wherein the zipper tape seal has a seal strength of approximately 26 pounds of force.

6. The zipper bag sealing assembly of claim 1, wherein the first and second bag sidewalls are a plastic material.

7. The zipper sealing assembly of claim 6, wherein the first and second bag sidewalls include a first layer of polyethylene terephthalate, a second layer of metalized polyethylene terephthalate, and a third layer of linear low-density polyethylene.

8. The zipper sealing assembly of claim 1, wherein the first and second sealing members are a plastic material.

9. The zipper sealing assembly of claim 8, wherein the plastic material is polyethylene.

10. The sealable bag of claim 1, further comprising a thermal insulating lining layer in the first and second sidewalls.

11. The sealable bag of claim 1, wherein the zipper tape seal has a downward opening force of approximately 19 pounds on the first and second sealing members.

12. The sealable bag of claim 1, wherein the zipper tape seal has a downward opening force of at least 19 pounds on the first and second sealing members.

13. The sealable bag of claim 1, further comprising a finger hold in at least one of the first and second bag sidewalls.

14. The sealable bag of claim 13, wherein zipper tape seal is located proximate to one of the interior sides of the first and second bag sidewalls.

15. A method of opening a zipper-sealed bag having first and second opposing sidewalls, an opening between the first and second sidewalls, a zipper tape seal attached to the bag at the opening and configured to be alternated between a sealed and unsealed state, the seal having a first sealing member secured to the first sidewall along a portion of the opening, and a second sealing member secured to the second sidewall along a portion of the opening, the first sidewall having a first flap at a top edge thereof, and the second sidewall having a second flap at a top edge thereof, the method comprising:

grasping the first flap of the first sidewall with a user's first hand, grasping the second flap of the second sidewall with a user's other hand, the user pressing with a downward force on each of the first and second sealing members while simultaneously pulling the first and second sidewalls in generally opposing directions.

16. The method of claim 15, wherein the at least one of the first and second sidewalls includes a finger hold, and at least one of the steps of grasping the first or second sidewall includes inserting a user's finger in the finger hold.

17. The method of claim 15, wherein the downward force is approximately 19 pounds of force.

18. The method of claim 15, wherein the downward force is at least 19 pounds of force.

19. A zipper bag sealing assembly comprising:

a bag having an opening;

a zipper tape seal attached to the bag at the opening and configured to be alternated between a sealed and unsealed state, the zipper tape seal including:

a first sealing member secured to a first bag sidewall along a portion of the opening, the first sealing member including a first extension and a receiving element, the receiving element having an upper segment with a substantially C-shaped cross-section and a lower segment with a substantially C-shaped cross-section smaller than and extending from the upper segment, wherein one end of the first extension connects to the first bag sidewall and another end connects to the upper segment of the receiving element;

a second sealing member secured to a second bag sidewall along another portion of the opening opposite the first sealing member, the second sealing member including a second extension and an insertion element, the insertion element having an upper segment with a substantially C-shaped cross-section and a lower segment with a substantially J-shaped cross-section extending from the upper segment, wherein one end of the second extension connects to the second bag sidewall and another end connects to the lower segment of the insertion element, wherein when the zipper tape seal is in the sealed state the upper segment of the insertion element nests within the upper segment of the receiving element and the lower segment of the insertion element nests within the lower segment of the receiving element;

a first flap at a top edge of the first sidewall, and a second flap at a top edge of the second sidewall;

wherein the zipper tape seal has a seal strength sufficient to prevent a child from opening the seal; and wherein the zipper tape seal has a downward opening force in the range of approximately 19 pounds.

* * * * *